US005946999A

United States Patent [19]

Kahn

[11] Patent Number: 5,946,999

[45] Date of Patent: Sep. 7, 1999

[54] CLEAR PLASTIC SCORING BOARD

[76] Inventor: Leonard C. Kahn, 7 Hativat Givati (18) or c/o Dr. Saul Kahn, 4000 Clifford Dr., Metaire, La. 70002

[21] Appl. No.: 08/987,602

[22] Filed: Dec. 10, 1997

[51] Int. Cl.[6] ..... B26D 3/08; B43C 19/16

[52] U.S. Cl. ..... 83/879; 83/886; 33/32.1; 33/32.2; 33/32.3

[58] Field of Search ..... 83/879, 658, 953, 83/467.1, 468.1, 884, 886; D7/698; D8/45; 33/20.1, 20.2, 32.3, 32.1, 32.2, 41.1; 451/106, 103, 109, 182, 260, 267, 412, 545, 549, 555, 451, 457; 30/294, 282

[56] References Cited

U.S. PATENT DOCUMENTS

| | | | |
|---|---|---|---|
| 2,034,177 | 3/1936 | Flatt | 33/32.3 |
| 2,058,091 | 10/1936 | Marsella et al. | 33/32.3 |
| 2,814,163 | 11/1957 | Krulwich | 83/886 X |
| 3,800,639 | 4/1974 | Restel | 83/886 X |
| 3,812,748 | 5/1974 | Nausbaum | 83/886 X |
| 3,963,159 | 6/1976 | Krulwich | 83/879 X |
| 3,995,522 | 12/1976 | Holliday | 83/467.1 X |
| 4,120,220 | 10/1978 | Mullen | 83/886 X |
| 4,275,633 | 6/1981 | Littlehorn | 83/886 X |
| 4,679,476 | 7/1987 | Abreu | 83/886 |

*Primary Examiner*—M. Rachuba

[57] ABSTRACT

This invention is a clear plastic board used specifically for scoring a straight line when place on top of glass or stained glass. The invention allows the artisan to comfortably move the board so as to score by seeing his pattern through the clear plastic and selecting exactly the color of the stained glass that he wishes to use in his artwork. A slot in the middle of the board allows a more expensive type of cutter as well as the less expensive glass cutter to score and glide easily from bottom to top or top to bottom (as some artisans prefer) and effectively score a straight line on the glass. The slot also prevents slipping to the side as would be true when using a straight edge or T square and allows for a stronger and more rigid scoring. The scoring board also has topside and underside rubber strips to prevent slippage, as would be true when using a straight edge, allowing for the effective scoring of horizontal and vertical lines and to diminish wear and tear to the cutter's carbide wheel.

1 Claim, 2 Drawing Sheets

CLEAR PLASTIC SCORING BOARD

BACKGROUND OF THE INVENTION

The invention is to solve the problem of the slipping of a scoring tool when a straight edge is used as opposed to a slot into which the scoring tool can fit and make a perfect score, as more pressure can be confidently applied. The invention also solves the problem of the carbide wheel of the scoring tool from sliding off the glass and being damaged. In this connection, it is pointed out that it is not necessary for the scoring tool to go off the edge of the glass for an effective break. However, even a skilled stained glass craftsman will sometime not stop before going off the edge of the glass.

While not a major solution, the clear plastic used in this invention allows the artisan to select the color configuration, as is sometimes found in stained glass, that he would want to use in his project. Since this unit is so mobile, the same or different patterns can be scored for breaking.

BRIEF SUMMARY OF THE INVENTION

The invention is a clear plastic board used specifically for scoring a straight line when placed on top of glass or stained glass. It's use is primarily for stained glass artisans. The slot, cut in the middle of the board is $3/16^{th}$ of an inch wide. The slot allows a more expensive pistol type cutter as well as the less expensive glass cutter, to score and glide easily from bottom to top or top to bottom (as some artisans prefer) and effectively score a straight line on the glass. The rubberized strip at the top permits causing a ninety degree right angle to be scored just as a T square would permit.

The slot prevents slipping to the side as would be true when using as straight edge or T square. This slot also allows for a stronger and more rigid scoring.

Since this product is made of clear plastic, it is inexpensive to produce. A special feature of the clear plastic is that the artisan can comfortably move the board so as to score by seeing his pattern through the clear plastic and selecting exactly the colors of the stained glass that he wishes to use in his art work. To clarify this, it is pointed out that many times the stained glass configuration has a mixture of colors.

This unit is useful in that it can be easily moved, takes up a small amount of space, and will permit usage without disturbing other items on the artisan's work table. Of course, for larger pieces of glass or stained glass, a much heavier, longer and expensive T square is used by professionals. But usually, this is not common, and this invention is for the stained glass artisan and hobbyist.

This board is also different from other products in that:

It is specifically for glass and stained glass;

It is inexpensive;

it is used for scoring with glass cutters that will fit into a $3/16^{th}$ inch wide slot;

It has a rubberized strip to prevent slippage, as would be true when using a straight edge, and allows for effective scoring of horizontal and vertical lines;

The clear plastic allows for selectivity in scoring stained glass of various sizes;

Since it is easily moved, and takes up a small amount of space, scoring can be done easily with one slot and moved to score an equal or different size line of the glass-one is not limited of the second, third, ad infinitum of the next score;

Scoring into the rubberized strip diminishes wear and tear on the cutter's carbide wheel.

A cork work table, as is customarily used, is excellent for holding the glass or stained glass steady for either a horizontal or vertical score. The rubberized strip is placed on the bottom and a like strip of the same material is on top and slightly forward. The forward strip will prevent the glass cutter's carbide wheel from being damaged, as it stops the cutter's wheel before it reaches the edge of the glass. This invention is not confined as is the plate cutting frame type. Irregular shaped stained glass can be scored for cutting, unlike the restrictions of the plate cutting frame.

While scoring stained glass with a straight edge, it became obvious to this hobbyist that a device was necessary in order to be able to score a perfect straight line without fear of shipping off to the side and causing excessive wear and tear on the carbide of the cutting wheel. Once this clear plastic scoring board was used, it became obvious that the above problems were solved. It became easier to make a stronger score, which provided for a much easier breaking of the scored glass with a breaker. It was obvious that not only was this invention practical and simple, but also very inexpensive and would be most helpful for a stained glass hobbyist or artisan.

Figure 1:
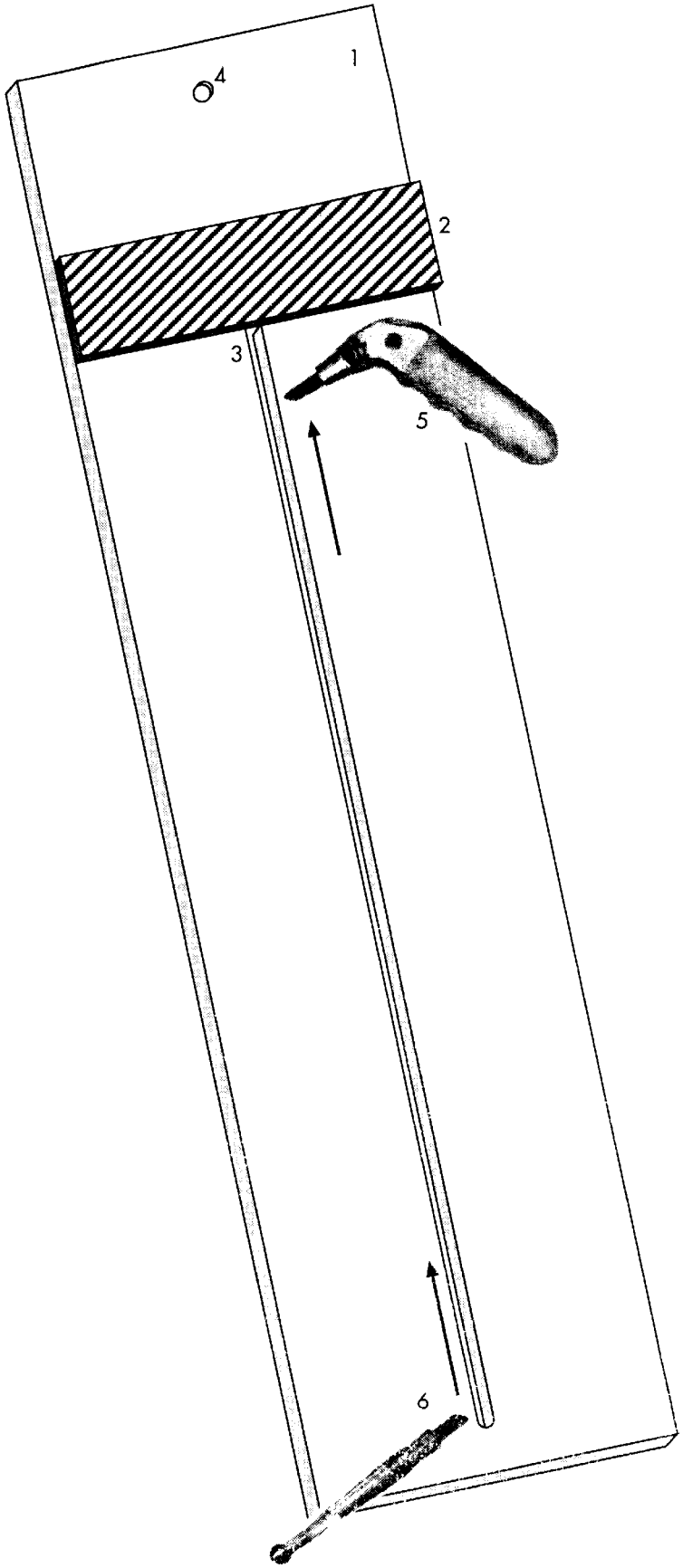
FIG. 1 is a view of the topside of the clear plastic scoring board.
Figure 2:
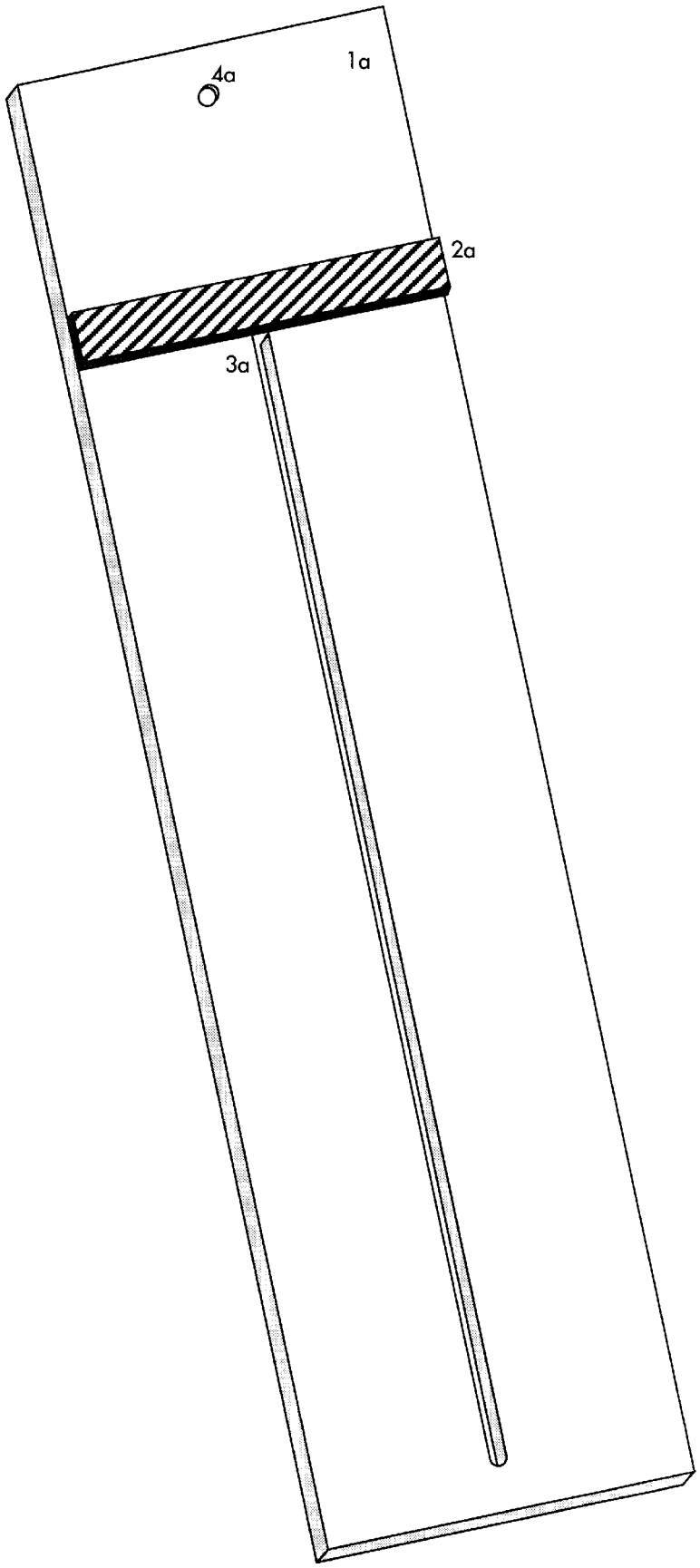
FIG. 2 is a view of the underside of the clear plastic scoring board.

The drawings in FIG. 1 and FIG. 2 do not use the symbols as suggested for plastic, as it would interfere with the purpose of showing the clearness of this board, which is essential to the better understanding the purpose of this invention.

DETAILED DESCRIPTION OF THE INVENTION

FIG. 1 is a view of the topside of the clear plastic scoring board 1. The clear plastic scoring board measures 18" long, but also can be as short as 10" in another embodiment of the board. The clear plastic scoring board is 4½" wide and ⅛" thick. On the topside of the clear plastic scoring board 1 is an upper rubberized strip 2. The upper rubberized strip 2 is 4½" long, running the entire width of the topside of the clear plastic scoring board 1, 2½" wide, and ⅛" thick. The upper rubberized strip 2 is approximately 2 and $1/8^{th}$ inches down from the top edge of the board and is slightly in front of the underside rubber strip 2*a*, as seen in FIG. 2.

A slot 3, which is $3/16^{th}$ of an inch in width, is cut down the middle of the topside of the clear plastic scoring board 1, through the thickness of the board forming slot 3*a* on the underside of the clear plastic scoring board 1*a*. Slot 3, 3*a* goes vertically and starts one inch above the bottom edge of the clear plastic board, running a total of approximately 14 inches.

A hole 4 is drilled into the topside of the clear plastic scoring board 1 to the underside of the clear plastic scoring board 1*a* forming a hole 4*a* on the underside, allowing for easy and convenient storage when not in use.

A pistol grip hand cutting tool 5 is inserted in the slot 3 to score the glass. The pistol grip hand cutting tool 5 travels from the bottom end of the slot to the top and into the upper rubberized strip 2.

The clear plastic scoring board can be used with other types of hand cutting tools, such as 6, using the same carbide wheel allowing the tool to fit into the slot 3. These tools are also inserted into the slot 3 and move from the bottom end to the top of the slot 3 into the upper rubberized strip 2.

FIG. 2 is a view of the underside of the clear plastic scoring board 1*a*. All of the dimensions, as illustrated in FIG. 1, are the same except that the underside rubberized strip 2*a* is closer to the top edge. The underside rubber strip 2*a* is 2" wide in order to allow the front rubberized strip to intercept the carbide wheel of the cutting tool 5,6.

I claim that this invention has utility in that:

1. A device for scoring glass consisting of:

a clear plastic board of rectangular shape having a topside, a bottom side and a longitudinal center axis, a slot extending through the clear plastic board and running substantially along the longitudinal center axis into which a glass cutter, having a carbide wheel, can be inserted, two rubber strips, one placed on the topside and one placed on the bottom side of the clear plastic board, along an axis transverse to the longitudinal center and located at one end of the slot, wherein the rubber strip on the topside partially overlaps the slot to form a stop within the slot to stop the movement of the glass cutter during scoring to prevent damage to the glass cutter's carbide wheel.

* * * * *

UNITED STATES PATENT AND TRADEMARK OFFICE

CERTIFICATE OF CORRECTION

PATENT NO. : 5,946,999
DATED : September 7, 1999
INVENTOR(S) : Leonard C. Kahn

It is certified that error appears in the above-identified patent and that said Letters Patent is hereby corrected as shown below:

Title page, item [76] , inventor's address, insert -- Raanana, Israel--

Signed and Sealed this

Twenty-first Day of March, 2000

*Attest:*

*Attesting Officer*

Q. TODD DICKINSON

*Commissioner of Patents and Trademarks*